United States Patent [19]

Otsuka

[11] 4,009,370

[45] Feb. 22, 1977

[54] COUNTING OR INDICATING RING DEVICE

[75] Inventor: Kouichi Otsuka, Chiba, Japan

[73] Assignee: Kabushiki Kaisha Daini Seikosha, Japan

[22] Filed: June 10, 1975

[21] Appl. No.: 585,510

[30] Foreign Application Priority Data

June 10, 1974 Japan ..... 49-67188[U]

[52] U.S. Cl. ..... 235/64; 235/103; 235/117 A; 235/144 DM; 235/144 S; 235/144 SM

[51] Int. Cl.[2] ..... B43K 29/08; G06C 27/00; G06C 15/42

[58] Field of Search ..... 235/64, 103, 117, 130 R, 235/144 R, 144 DM, 144 S, 144 SM, 144 SP; 116/73, 114 W, 129 A

[56] References Cited

UNITED STATES PATENTS

| | | | |
|---|---|---|---|
| 3,390,834 | 7/1968 | Seiden | 235/144 R |
| 3,843,047 | 10/1974 | Otsuka et al. | 235/64 |

*Primary Examiner*—E. S. Jackmon
*Attorney, Agent, or Firm*—Robert E. Burns; Emmanuel J. Lobato; Bruce L. Adams

[57] ABSTRACT

A counting or indicating ring device has indicating rings which are respectively provided with numerals or marks on a pitch circle thereof and are supported by a shaft, step advancing means spaced adjacent to one of the indicating rings to advance it step by step, operating means arranged parallel and eccentric to the ring axis and longitudinally movable to operate the step advancing means relative to the indicating rings, resetting means for resetting the indicating rings and which includes a knob to drive the shaft to rotate after pushing operation thereof, and a stopping bar spaced close to the indicating ring peripheries coacting with the pushing operation of the knob. The shaft has a click-stop spaced in the casing for stopping the shaft at a predetermined angular position thereof. The knob is also used for effecting the engagement and disengagement of the operating means with the step advancing means, with a proper angular rotation without pushing-in. Mistaken or faulty pushings-in of the knob at an unsuitable angular position are obstructed by obstructing members. An indicating window is provided close to the indicating ring periphery opposite to the stopping bar in the casing.

4 Claims, 9 Drawing Figures

COUNTING OR INDICATING RING DEVICE

BACKGROUND OF THE INVENTION

This invention relates to an indicating device having indicating rings which are respectively provided with a plurality of letters, numerals or other figures on the periphery thereof, such as mechanical counters and more particularly to improvements in a portable indicating device having an accompanying writing means.

In the prior art to which the invention is directed, a shaft which rotatably supports the indicating rings is rotated by a knob for resetting the indicating rings. Therefore, the indication is often disturbed by a misoperation during either the indicating or counting operation. The knob is shiftable to an engageable state or to a disengageable state, and the shaft is rotated together with the rings, where are in half connection with the knob, by the knob rotation accompanying the pushing operation of the knob while in its disengaged angular state. Too much pushing force applied to the knob is harmful and causes damage to the fine engaging members.

BRIEF SUMMARY OF THE INVENTION

An object of this invention is to provide an indicating device having indicating rings in which the afore-mentioned faulty operation is automatically prevented.

Another object of the invention is to provide a fine and handy indicating device with reliable operation.

Other objects and aspects of the invention will become apparent from the following description of preferred embodiments thereof with reference to the accompanying drawings.

BRIEF DESCRIPTION OF THE DRAWINGS

FIGS. 1 to 6 show a first preferred embodiment in which

FIG. 1 is a longitudinal sectional view,

FIG. 2 is a schematic view showing a step advancing means for the indicating rings, FIG. 4 is a schematic view showing a changeover sleeve, FIG. 5 is a sectional view taken on line V—V on FIG. 1 and FIG. 6 is a sectional view taken on line VI—VI in FIG. 1.

DETAILED DESCRIPTION OF THE PREFERRED EMBODIMENTS

Figure 1:
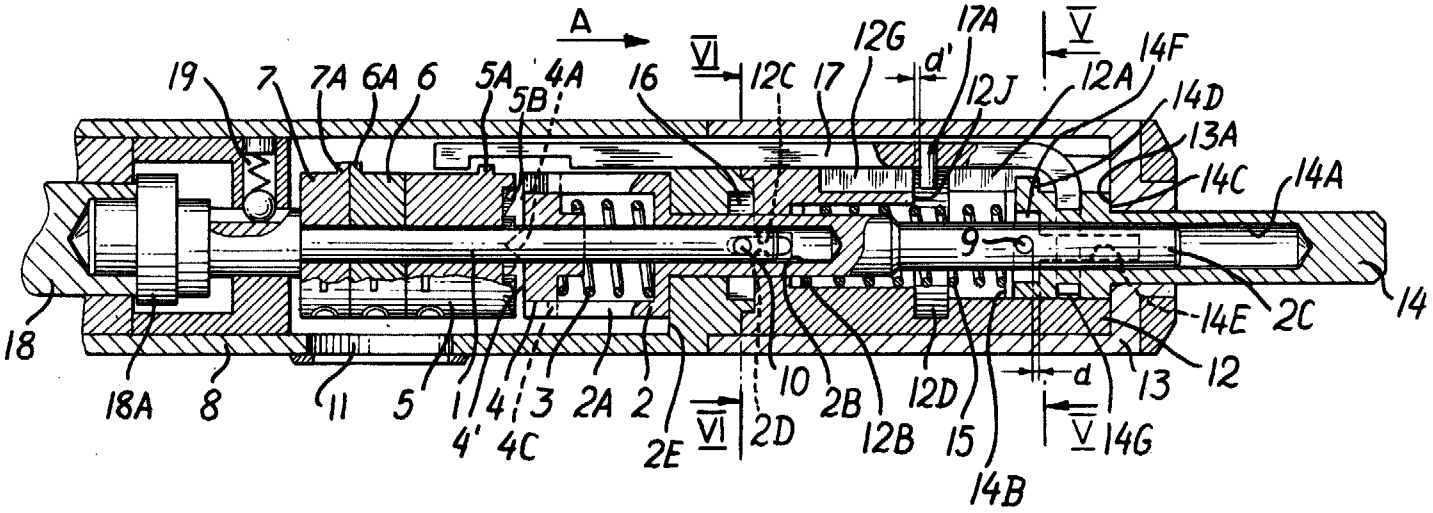
Figure 2:
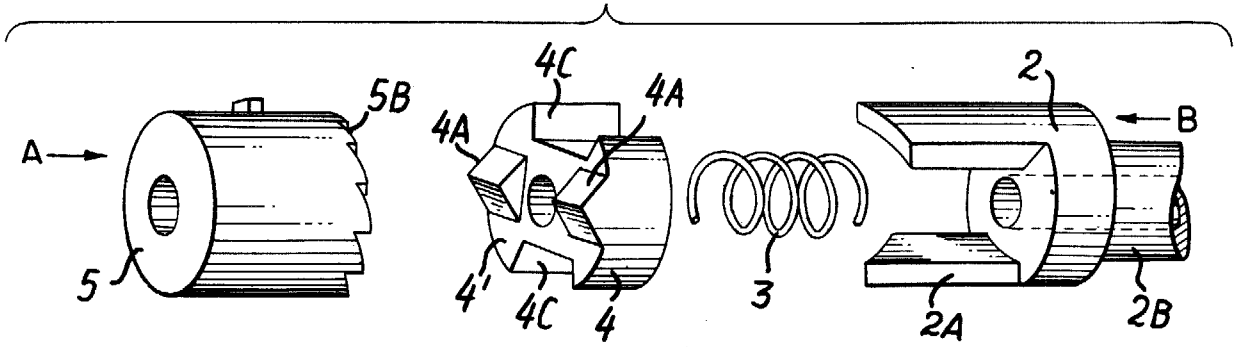

A first embodiment of writing instrument with counter is shown in FIGS. 1 to 6, wherein FIG. 1 is a longitudinal sectional view of the writing instrument. Reference numeral 1 is a shaft whose inner end portion extends into the hollow of sleeve 2B formed on the base of a feed fork 2. The feed fork 2 has a pair of projections 2A as is well shown in FIG. 2, each of which is inserted into a peripheral slot 4C of a stop seat 4 slidably and rotatably mounted on the shaft 1. A coiled spring 3 is mounted on the shaft compressed between the feed fork 2 and the stop seat 4. A pair of lugs 4A protrude from the front end surface 4' of the stop seat 4. The lugs 4A are forced to engage with ratchet 5B on the rear end of a first counter ring 5 by the spring 3. The ratchet has ten teeth, and the counter ring 5 has ten digits corresponding to the teeth ranging from zero to nine on the periphery thereof and is intermittently rotated by the combination of the feed fork 2 and the stop seat 4, one reciprocation of the feed fork 2 making one step advancing of the counter or indicating ring 5 and changing the numeral which is indicated or displayed out of a window 11 of a case 8.

This step advancing operation of the first counter ring 5 will be described referring to FIGS. 3(A) to 3(C).

Figures 3A, 3B, 3C:
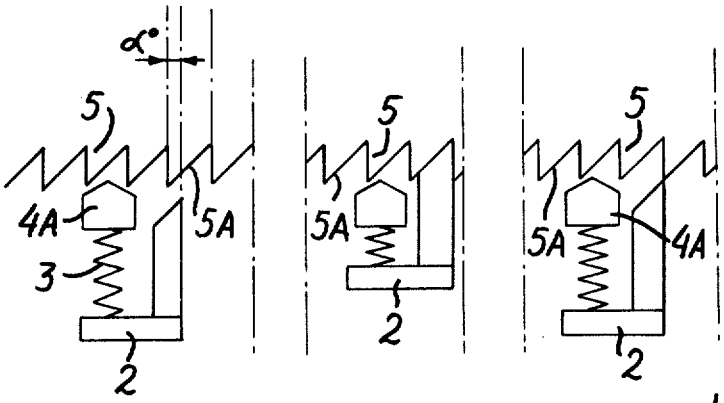
FIGS. 3(A), 3(B) and 3(C) are diagrammatic views illustrating the actuation and functioning of the step advancing.

As the feed fork 2 relatively moves toward the ratchet 5A from a state of FIG. 3(A) to that of FIG. 3(B), the counter ring 5 is actuated to rotate by $(36-\alpha)°$, thereby pressing the stop seat lugs 4A against the spring force. When the feed fork is returned back as shown in FIG. 3(C), the stop seat lugs 4A moves forward with the aid of the spring 3, rotating the ring 5 by $\alpha°$ till the relative location of the members returns to the state shown in FIG. 3(A). Thus, one reciprocating movement of the feed fork 2 causes a step advancing of 36° on the counting ring 5.

The first counting ring 5 is engaged with a second counting ring 6, the second counting ring being engaged with a third counting ring 7, all of these rings being mounted rotatably and coaxially on the shaft 1 as shown in FIG. 1. Each of the counting rings is in such engagement with the adjacent ring that a well-known arithmetic carrying mechanism is mounted therebetween. The first counter ring 5 counts units, the second counter ring 6 counts tens and the third counter ring 7 counts hundreds. When the units counting ring 5 completes a full rotation after ten steps advancing steps, it rotates the tens counting ring 6 by 36°. A full rotation of the tens counting ring 6 effects in turn the hundreds counting ring 7 a set advancing of 36°.

Each of the counter rings 5, 6 and 7 has a click-stop mechanism (not shown in the drawings) onto the shaft 1 such that the numerals on the rings are just located at suitable positions for indicating counting numbers through the window 11.

Each of the counter rings has a lug 5A, 6A or 7A on the periphery thereof. A stopping bar 17 is spaced along a parallel line to the shaft axis, engageable with the counter ring lugs 5A, 6A and 7A, for resetting them to zero indication. The stopping bar 17 is movable in the longitudinal direction guided by a hollow in the case 8, the rear end portion thereof extending to bend into an annular groove 14G of a knob 14.

The shaft 1 has a pin 10 fixed thereon perpendicular to the axis. Both ends of the pin 10 extends into a recess 16 at the case end penetrating through slots 2D on the feed fork sleeve 2B, thereby allowing, by the slot length, longitudinal movement of the shaft 1 and no relative rotation to the shaft 1 and the fork 2.

The shaft-like end portion 2C of the feed fork 2 is inserted so as to be slidable and rotatable into a hollow 14A of the knob 14 and has a small pin 9 fixed thereon perpendicular to the axis. Both ends of the pin 9 extend into a recess 14F at the front end of the knob 14.

Figure 4:
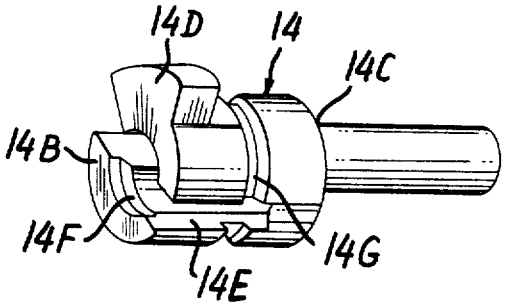

Numeral 13 designates an end cover securely fixed on the rear end of the case 8 and holding rotatably a changeover sleeve 12 therein. The feed fork sleeve 2B is rotatably supported on this changeover sleeve 12 as well as on the case end. The knob 14 is supported on the end cover 13 rotatably and slidably, the handling portion thereof protruding out through the end cover 13 and the lump portion being surrounded by the changeover sleeve 12. The knob 14 is illustrated in FIG. 4 wherein numeral 14D is a protrusion engaged slideably with a longitudinal groove 12A of the changeover sleeve 12 as shown in FIG. 5, so that the sleeve 12 is rotated together with the knob 14 but the knob 14 is slidable in the longitudinal direction with respect to the sleeve 12.

A coiled spring 15 is compressed between the hollow bottom 12B of the changeover sleeve 12 and the front end surface 14B of the knob 14, thereby pressing the knob shoulder 14C against the end cover bottom 13A.

Figure 6:
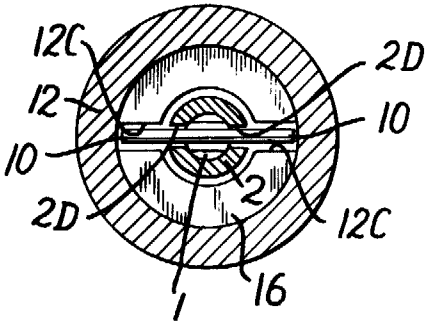

The changeover sleeve 12 has a pair of slots 12C parallel to the axis thereof opening to the front end surface which faces the recess 16 of the case 8. These slots 12C are provided to receive the pin 10 when the sleeve 12 is in an angular coincident position with the shaft 1 as shown in FIG. 6, thereby permitting movement of the shaft 1 in the direction of arrow A against the spring 3, to cause the afore-mentioned step-advancings of the counter rings 5, 6 and 7.

Figure 5:
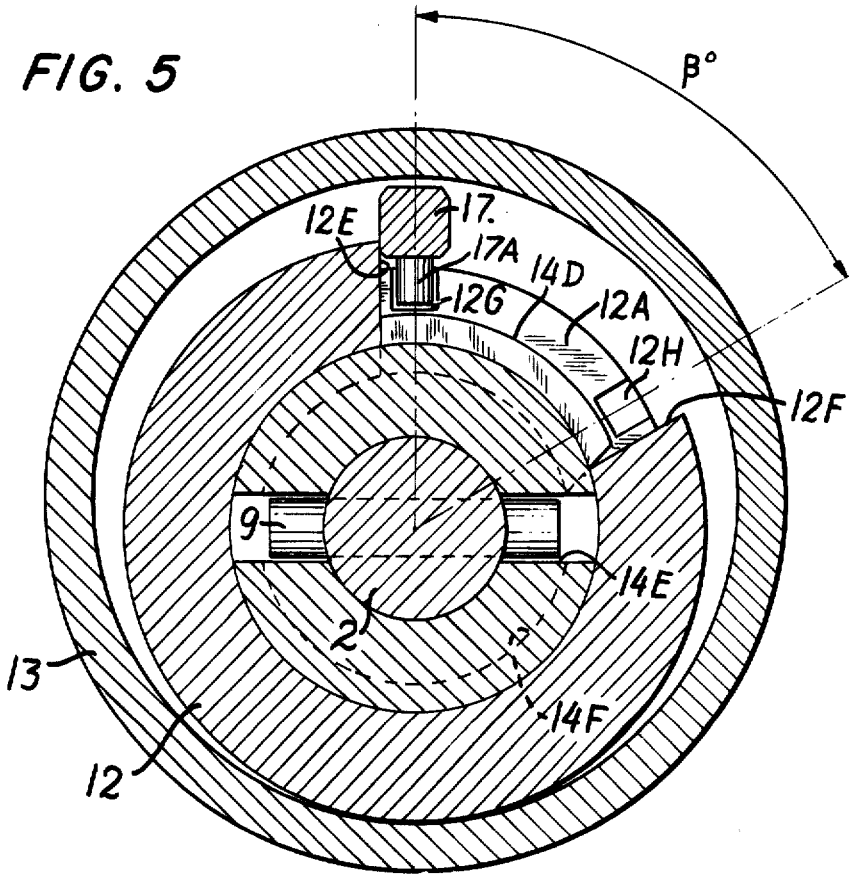

The knob 14 has a pair of longitudinal slots 14E opening to the recess 14F which are adaptable to receive the pin 9 when the knob 14 is pushed in against the spring 15 at an angular coincident position with the feed fork 2 as shown in FIG. 5.

The stopping bar 17 has a pin 17A protruded inward to a depression 12D of the changeover sleeve. A pair of longitudinal grooves 12G and 12H spaced $\beta°$ from each other as shown in FIG. 5 is opened to the depression 12D, each of the grooves 12G and 12H receiving the pin 17A when it is positioned at the coincident angular position with the stopping bar 17. The groove 12G is used for the resetting operation and the groove 12H is for the counting operation by the knob pushing, as is described later.

It is to be noted that the gap $d'$ between a depression wall 12J and the pin 17A is smaller than the gap $d$ between the bottom wall of the recess 14F and the pin 9, which is shown in FIG. 1.

The stopping bar 17 restricts the changeover sleeve rotation within $\beta°$, a side wall thereof being to touch a side wall 12E or 12F of the longitudinal groove 12A.

Numeral 18 in FIG. 1 designates a pen filler for a ball pen, supported longitudinally slidable in the case 8. The pen filler 18 has a bushing 18A made of synthetic resin at the rear end thereof. The shaft end is forced against the bushing 18A by the spring 3, the shaft axis being eccentric to the pen filler axis.

Numeral 19 designates a click-stop mechanism, which operates in a manner that a ball engages in a longitudinal groove on the shaft 1 when the protrusion 14D of the knob 14 is in the changeover sleeve groove 12A and the slots 14E are at a coincident angle to the pin 9.

The operation of this embodiment will be now described hereinafter.

For counting ball pen checking number, the knob 14 is turned clockwise, the stopping bar 17 being in contact with the left side wall 12E as shown in FIG. 5. In this case, the slots 14E of the knob 14 are in coincidence with the pin 9 of the fork 2, the slots 12C of the changeover sleeve 12 are in coincidence with the pin 10 of the shaft 1 as shown in FIG. 6, and the groove 12G is in coincidence with the stopping bar pin 17A. A checking operation to mark or check a on paper sheet with the pen point at the top of the pen filler 18 causes movement of the pen filler 18 in the direction of arrow A and the shaft 1 together with the counter rings 5, 6 and 7, the pin 10 sliding along the slots 2D and 12C. As the feed fork 2 remains still in contact with the case bottom, a relative approach of the feed fork 2 to the first container ring 5 occurs in response to a check operation of the ball pen point, so that a step advancing of counting in the counter rings is effected as described before. The knob 14 is ineffective for undergoing a pushing operation in this case, as the pin 9 would penetrate into the slots 14E and the pin 17A would penetrate into the groove 12G.

Resetting operation is effected as follows.

After pushing the knob 14 at the above angular position against the spring 15 till the protrusion 14D reaches in the depression 12D of the sleeve 12 thereby escaping from the longitudinal groove 12A, a clockwise full rotation of the knob 14 is succeeded. In this rotary motion, the changeover sleeve 12 is disengaged in rotational relation with the knob 14 and the feed fork 2 is in turn engaged with the knob through the pin 9 and the slots 14E. Therefore, the shaft 1 is rotated a full rotation, disengaging the click-stop 19, together with the feed fork 2 synchronously to the knob rotation, driving the counter rings 5, 6 and 7 with friction force, while the stopping bar 17 has been shifted to the leftward position together with the knob 14, the pin 17A penetrating into the groove 12G and the top portion of the bar being located at the stopping position for the counter ring lugs 5A, 6A and 7A. Thus, each of the counter rings is stopped indicating zero at the window 11 when its lug touches the stopping bar 17, and all the the counter rings are reset after a full rotation of the knob 14. Returning at the initial angular position, the click-stop 19 stops the shaft 1 again and the protrusion 14D of the knob 14 is forced into the groove 12A by the spring 15, thereby the knob 14 returns outward.

The writing instrument is also used as an ordinary ball pen for writing, the knob being in turn used as a counter knob. For this use, the knob 14 is rotated counterclockwise till the side wall 12F touches the stopping bar 17, the slots 14E being beside the angular position of the pin 9 and the slots 12C of the sleeve 12 being beside the angular position of the pin 10, thereby blocking the shaft longitudinal movement and making the bottom surface of the recess 14F face to the pin 9. In this case, the groove 12H of the changeover sleeve 12 is located in coincidence with the stopping bar pin 17A. A pushing operation of the knob 14 makes the feed fork 2 approach the first counter ring 5 as the above bottom face pushes the pin 9, thereby performing a step advancing of the counter rings. Excessive pushing stroke of the knob 14 is prevented by a touching of the pin 17A to the end side wall of the groove 12H, the length of the groove being suitable for the knob 14 to just effect the counting operation, otherwise damaging the pin 9.

Even if a faulty pushing operation of the knob 14 would be attempted at a half-way angular position of the knob, it is perfectly prevented, the depression wall 12J coming in contact to the pin 17A before the knob 14 pushes the pin 9 as the gap $d'$ is smaller than the gap $d$. Therefore, there is no danger of forcing the shaft 1 and the fork 2 to rotate with frictional torque transmitted to the pin 9 from the knob 14, which would put the counter ring indication out of order or would damage the pin 9.

This invention is also applicable to other writing instruments such as an instrument, in which both of the ball pen point and the knob are used for counting at a state that the slots 12C is in coincidence with the pin 10 while the bottom of the recess 14F is faced to the pin 9, the angular position of this pin 9 being beside that pin 10, and, at the other angular position of the knob 14, neither the ball pen point nor the knob can be used for counting and only resetting operation is permitted, the slots 12C being off beside the pin 10 and the slots 14E being in coincidence with the pin 9.

Figure 7:
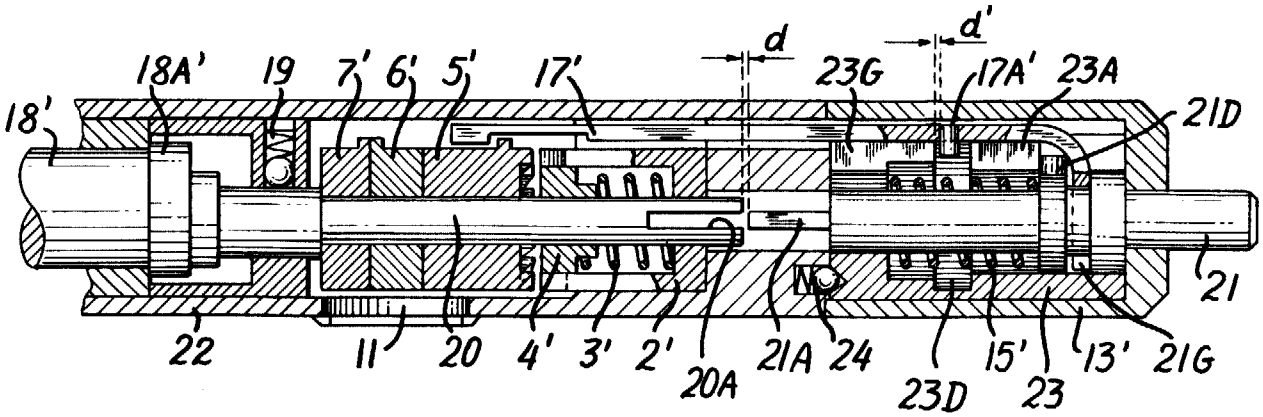
FIG. 7 is a longitudinal sectional view showing a second embodiment.

A second preferred embodiment is illustrated in FIG. 7, in which numeral 20 designates a shaft having an open slot 20A at the rear end thereof. The shaft 20 has a set of counter rings 5', 6' and 7' in the same manner as in the first embodiment. A feed fork 2' is fixed on a case 22 facing the first counter ring 5'.

A knob 21 is spaced along the rear extended axis of the shaft 20. The knob 21 has a protrusion 21D engageable with a groove 23A of the changeover sleeve 23 and an annular groove 21G receiving a bent end of a stopping bar 17'. A spring 15' compressed between the sleeve 23 and the knob 21 presses the knob 21 rightward. A flat end portion 21A is formed engageable with the open slot 20A at the end of the knob 21.

The sleeve 23 corresponds to the changeover sleeve 12 in the first embodiment, being held in a cover 13', rotatable together with the knob 21 the protrusion 21D thereof being engaged with the groove 23A. The sleeve 23 further has another longitudinal groove 23G and a depression 23D. A click-stop 24 operates to stop rotation of the sleeve 23 at both the angular positions of the sleeve 23 where one side wall of the groove 23A touches the stopping bar 17'.

Other numerals with "'" in FIG. 7 designate parts corresponding to those indicated by corresponding numerals without "'" in FIG. 1.

After the counterclockwise rotation of the knob 21 with setting as in FIG. 7, a ball pen point check effects rightward movement to the shaft 18', the open slot 20A receiving the flat portion 21A, thereby making the first counter ring 5' become engaged with the feed fork 2' and performing a step advancing on the counter rings.

Resetting is performed by pushing-in and then rotating of the knob 21, the open slot 20A receiving the flat portion 21A of the knob 21 and the protrusion 21D reaching in the depression 23D out of the groove 23A.

What is claimed is:

1. An indicating device comprising: indicating rings rotatably supported by a shaft, each of said rings having numerals or marks on a pitch circle thereof, step advancing means spaced adjacent to one of said rings to advance it step by step, operating means arranged parallel to the ring axis and longitudinally movable to operate said step advancing means relative to the indicating rings, a stopping bar arranged close to the indicating ring peripheries and engageable with a lug formed on the periphery of each of said indicating rings, means including a changeover sleeve for engaging and disengaging said operating means with the step advancing means, and means including a rotatable and slidable knob having two functions, one being to shift said stopping bar to stop the indicating rings in response to pushing-in of the knob so that said shaft can be rotated, accompanying the indicating rings with frictional torque, by rotation of the knob to effect an indicating ring resetting function, and the other being to rotate said changeover sleeve to an angular position to permit or prevent the engagement of said operating means with the step advancing means in response to rotation of the knob without pushing-in to effect a change-over function, said shaft being provided with a click-stop to stop the shaft at a predetermined angular position thereof thereby preventing the shaft from being rotated over with unexpected torque caused by knob misoperation or other accidents.

2. An indicating device claimed in claim 1, comprising obstructing means to block the engagement of said knob with the shaft while the knob is located in a halfway angular position unsuitable for the engagement thereby preventing damage to said operating means and step advancing means.

3. An indicating device claimed in claim 1, wherein said shaft is spaced adjacent to an indicating window which is formed in a case and which opens to display the indicating ring peripheries, said shaft being eccentric with respect to the axis of said operating means.

4. An indicating device as claimed in claim 2, wherein said means including a knob further includes means to reciprocatingly operate said step advancing means while engaged with the step advancing means through engaging members, and said obstructing means has means for blocking over-stroke of the knob.

* * * * *